US009395047B2

(12) United States Patent
Ding

(10) Patent No.: US 9,395,047 B2
(45) Date of Patent: Jul. 19, 2016

(54) COMPRESSED NATURAL GAS FLEET FILL MANAGEMENT SYSTEM

(71) Applicant: CLEAN ENERGY FUELS CORP., Newport Beach, CA (US)

(72) Inventor: Denis Ding, Riverside, CA (US)

(73) Assignee: CLEAN ENERGY FUELS CORP., Newport Beach, CA (US)

( * ) Notice: Subject to any disclaimer, the term of this patent is extended or adjusted under 35 U.S.C. 154(b) by 337 days.

(21) Appl. No.: 14/191,345

(22) Filed: Feb. 26, 2014

(65) Prior Publication Data

US 2014/0246117 A1 Sep. 4, 2014

Related U.S. Application Data

(60) Provisional application No. 61/771,718, filed on Mar. 1, 2013.

(51) Int. Cl.
*F17C 5/06* (2006.01)
*F17C 13/02* (2006.01)

(52) U.S. Cl.
CPC ..... *F17C 5/06* (2013.01); *F17C 13/025* (2013.01); *F17C 2205/013* (2013.01); *F17C 2205/058* (2013.01); *F17C 2221/033* (2013.01); *F17C 2223/0123* (2013.01); *F17C 2223/036* (2013.01); *F17C 2250/032* (2013.01); *F17C 2250/034* (2013.01); *F17C 2250/043* (2013.01); *F17C 2250/0439* (2013.01); *F17C 2250/0636* (2013.01); *F17C 2260/024* (2013.01); *F17C 2270/0168* (2013.01)

(58) Field of Classification Search
CPC ..... F17C 5/06; F17C 13/025; F17C 13/026; F17C 2250/043; F17C 2250/0439; F17C 2250/0636
USPC ..... 141/1, 2, 4, 18, 95, 197
See application file for complete search history.

(56) References Cited

U.S. PATENT DOCUMENTS

| | | | | |
|---|---|---|---|---|
| 5,465,583 | A | 11/1995 | Goode | |
| 5,628,349 | A | 5/1997 | Diggins et al. | |
| 8,708,005 | B2 * | 4/2014 | Mori | F17C 5/007 141/197 |
| 2002/0053365 | A1 | 5/2002 | Mutter | |
| 2005/0103400 | A1 | 5/2005 | Eichelberger et al. | |
| 2013/0112313 | A1 * | 5/2013 | Donnelly | B67D 7/04 141/4 |

OTHER PUBLICATIONS

Patent Cooperation Treaty, International Search Report for PCT/US2014/018916, Jun. 13, 2014, pp. 1-2.

* cited by examiner

*Primary Examiner* — Mark A Laurenzi
*Assistant Examiner* — Timothy P Kelly
(74) *Attorney, Agent, or Firm* — Sheppard Mullin Richter & Hampton LLP

(57) ABSTRACT

Methods and systems and are presented for estimating the amount of natural gas provided to a vehicle at a natural gas time-fill filling station. The methods comprise measuring and wirelessly transmitting pre- and post-fill pressures measurements of compressed natural gas in a compressed natural gas storage tank on-board a natural gas vehicle.

15 Claims, 4 Drawing Sheets

COMPRESSED NATURAL GAS FLEET FILL MANAGEMENT SYSTEM

CROSS-REFERENCE TO RELATED APPLICATIONS

This application claims the benefit of U.S. Provisional Application No. 61/771,718, filed on Mar. 1, 2013, the content of which is incorporated herein in its entirety.

FIELD OF THE INVENTION

The invention broadly relates to systems for measuring the refueling of compressed natural gas (CNG) vehicles.

BACKGROUND OF THE INVENTION

Natural gas vehicles (NGVs) operate on the same basic principles as other internal combustion-powered vehicles. Fuel, in the form of natural gas, is mixed with air and fed into a cylinder where the mixture is ignited to move a piston up and down. Natural gas can power vehicles currently powered by gasoline and diesel fuels. However, natural gas is a gas at standard temperature and pressure, rather than a liquid, so certain modifications to the vehicles are required, particularly to the engine and fuel receptacle and storage systems.

Most NGVs operate using compressed natural gas (CNG) so as to reduce the space required to store fuel on-board. CNG is typically stored on-board a vehicle under high pressure (3,000-3,600 pounds per square inch) in cylindrical containers that attach to the top, rear, or undercarriage of the vehicle. As CNG is a gas, direct measurement of the fill level of these containers cannot be accomplished as in gasoline powered vehicles, e.g., with a liquid fill level indicator. Rather, the pressure of the CNG in a storage tank reflects the fill level of the tank.

Fueling NGVs occurs at CNG stations, where natural gas is typically supplied from a local gas utility line at low pressure. There are two types of fueling systems typical employed for NGV refueling: fast-fill systems and time-fill (or slow-fill) systems.

Fast-fill systems require an a high-pressure storage tank system and an on-sight compressor to fill the high-pressure storage tank from the low-pressure gas utility line. NGVs are able to be filled from the high-pressure storage tank in about the same amount of time it takes to fuel a comparable gasoline or diesel fueled vehicle. The compressor systems and high-pressure storage tanks required in fast-fill systems, however, add complexity and cost to the fueling station.

An alternative is a time-fill system, which provides CNG to NGVs directly from a compressor. Time-fill systems typically utilize much smaller compressor systems than fast-fill systems, and do not require as much high-pressure storage capacity; typically a small buffer storage tank is sufficient. As such, time-fill systems have reduced complexity and cost relative to their fast-fill system counterparts. One disadvantage of time-fill system is that refueling takes significantly longer than it does on fast-fill system, so much so that NGV fleets refueled with a time-fill system are typically connected to the system and refueled overnight.

This extended refueling time presents certain logistical and monitoring difficulties for NGV fleet operators. Namely, refueling an NGV takes too long to refuel a fleet of vehicles one at a time. To address this, time-fill stations often use a manifold system with multiple refueling connections so that multiple NGVs may be refueled at the same time from the same gas source. Unfortunately, refueling multiple NGVs from the same manifold at the same time does not allow for simple measurement of how much fuel any individual NGV takes on while refueling.

SUMMARY OF THE INVENTION

One embodiment of the present invention is directed toward methods of estimating the amount of natural gas provided to a vehicle at a natural gas time-fill filling station. The methods comprise: measuring a first pressure of compressed natural gas in a compressed natural gas storage tank on-board a natural gas vehicle, wherein the first pressure is measured prior to refueling; wirelessly transmitting the first measured pressure to a receiver concurrent with or subsequent to the vehicle entering a time-fill filling station; connecting the vehicle to a time-fill filling station manifold and refueling the vehicle; disconnecting the vehicle from the time-fill filling station manifold and measuring a second pressure of compressed natural gas in the compressed natural gas storage tank on-board the natural gas vehicle, wherein the second pressure is measured after refueling; wirelessly transmitting the second measured pressure to the receiver concurrent with or prior to the vehicle departing from the time-fill filling station; and comparing the first and second measured pressures to estimate the amount of natural gas provided to the vehicle.

In some embodiments, the receiver is located at the filling-station and the first and second measured pressures are transmitted to the receiver via radio frequency (RF).

In some embodiments, an identification code is transmitted along with the first and second measured pressures, the identification code useful to identify a particular vehicle.

In some embodiments, the methods further comprise: measuring a first ambient or storage tank temperature at the same time the first pressure is measured; transmitting the first ambient or storage tank temperature to the receiver along with the first measured pressure; measuring a second ambient or storage tank temperature at the same time the second pressure is measured; and transmitting the second ambient or storage tank temperature to the receiver along with the second measured pressure; wherein the first measured pressure, second measured pressure, or both are adjusted based on the first and second measured temperatures prior to estimating the amount of natural gas provided to the vehicle while at the filling station.

In some embodiments, the methods further comprise: repeating the method for each of a plurality of natural gas vehicles wherein each of the plurality of natural gas vehicles receive fuel from the time-fill filling station manifold at the same time. In some related embodiments, the methods further comprise providing gas flowmeter data from the time-fill filling station indicating the total amount of gas provided to the plurality of natural gas vehicles refueled by the station. In some further related embodiments, the methods further comprise adjusting one or more estimates of the amount of natural gas provided to each of the plurality of natural gas vehicles refueled by the station so that the sum of estimates of natural gas provided to each of the plurality of natural gas vehicles corresponds with the gas flowmeter data.

Another embodiment of the present invention is directed to systems for the estimation of natural gas provided to a vehicle at a natural gas time-fill filling station. The systems comprise: a pressure sensor configured to measure a pressure of a compressed natural gas in a storage tank located on-board a natural gas vehicle; a radio-frequency transmitter configured to transmit data comprising the measured pressure of the compressed natural gas in the on-board storage tank from the natural gas vehicle to a radio-frequency receiver; a radio-frequency receiver configured to receive data transmitted by the radio-frequency transmitter, the receiver located at a natural gas time-fill station such that the receiver is within range of the transmitter both before and after vehicle refueling; a processor; and at least one computer program residing on the processor; wherein the computer program is stored on a non-transitory computer readable medium having computer executable program code embodied thereon, the computer executable program code configured to cause the computer to interface with the receiver and store data received by the receiver to a non-transient medium. While radio frequency is employed for wireless transmission in this embodiment, it would be understood to those of ordinary skill in the art that many other means of wireless transmission may be used including but not limited to: Wi-Fi, cellular, etc., without departing from the scope of the invention.

In some embodiments, the systems further comprise a temperature sensor configured to measure an ambient temperature or a temperature of the on-board storage tank when a pressure is measured; wherein the data transmitted by the radio-frequency transmitter further comprises the measured temperature.

In some embodiments, the systems further comprise a gas flowmeter configured to measure the amount of gas provided to a time-fill filling station manifold while one or more natural gas vehicle is being refueled.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

As discussed above, refueling stations for natural gas vehicles (NGVs), particularly time-fill refueling stations used to refuel multiple NGVs at the same time, can present challenges to fleet management. Provided herein are NGV fueling station systems that allow for improved fleet management with improved fuel fill monitoring capability. The systems described herein utilize a transmitter on-board each NGV to be fueled at the station that is capable of transmitting information from the vehicle to a receiver.

Figure 1A:
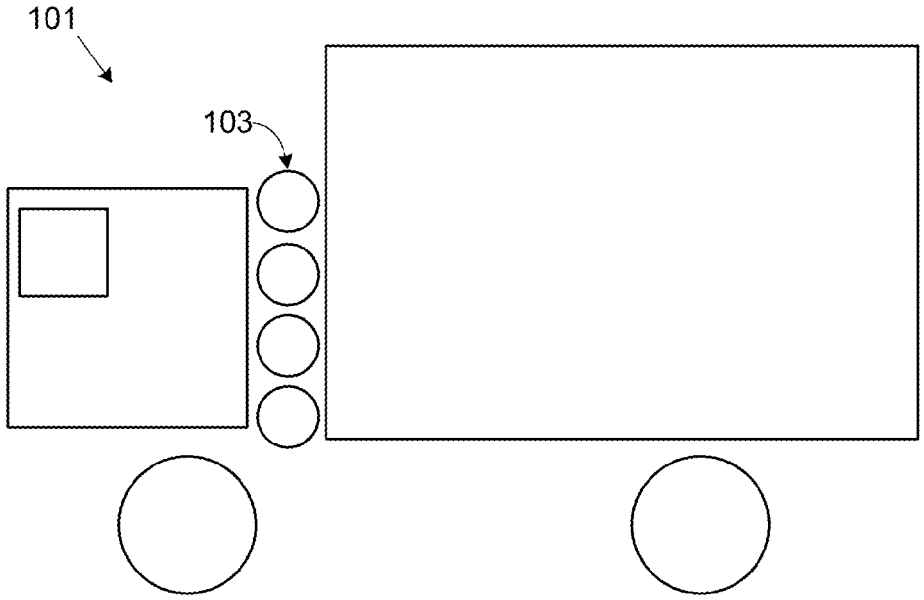
FIG. 1A is an illustration of a typical NGV configuration.
Figure 1B:
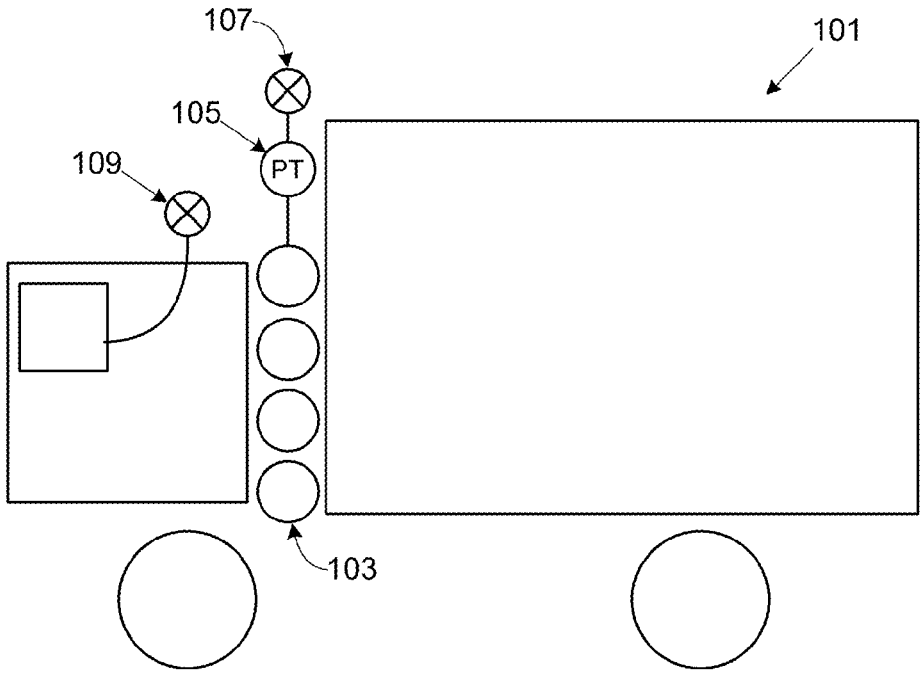
FIG. 1B is an exemplary vehicle configuration with an incorporated pressure sensor and transmitter according to one embodiment of the present invention.

The transmitter is integrated with the vehicle at least such that information regarding vehicle fuel level, preferably as a measure of the pressure of natural gas in an on-board fuel tank, is transmitted to a receiver. Such pressure data is typically measured with a pressure sensor configured to measure the pressure of natural gas in the on-board fuel tank. The transmitter is then configured to receive pressure data, either from pressure sensor directly or by interfacing with an on-board vehicle computer, and to transmit that data to a receiver. A typical NGV configuration and exemplary vehicle configuration incorporating a pressure sensor and transmitter according to one embodiment of the present invention are shown in FIGS. 1A and 1B. As seen in FIG. 1A, a typical NGV 101 has on-board gas storage tanks 103. FIG. 1B shows that a pressure sensor 105 may measure the pressure of the gas storage tanks 103. In some embodiments the data us provided directly to a transmitter 107. In other embodiments, the pressure sensor 105 is configured to provide measurements to an on-board vehicle computer, which is configured to provide the pressure data to a transmitter 109.

In addition to a measured pressure, additional data may be transmitted to a receiver as well, such as an identification code unique to the transmitter or vehicle, on-board fuel tank capacity, ambient temperature, temperature of the on-board fuel tank, distance traveled since last fill, average speed since last fill, time at idle since last fill, a GPS log of route traveled since last fill, etc. It should be recognized that this list is not exhaustive. Information that may be transmitted to a receiver is only limited by the type of sensors and tracking systems integrated with the vehicle and the transmitter.

A transmitter/receiver pair used in the present invention may be any suitable transmitter/receiver pair known in the art so long as the transmitted data is able to be remotely received by the receiver. It should be recognized by one of ordinary skill in the art that the desired location of a receiver may restrict the types of transmitter/receiver pairs that can be used. In some embodiments, the receiver is located on-site at the refueling station. In alternative embodiments, the receiver is located off-site.

Figure 2:
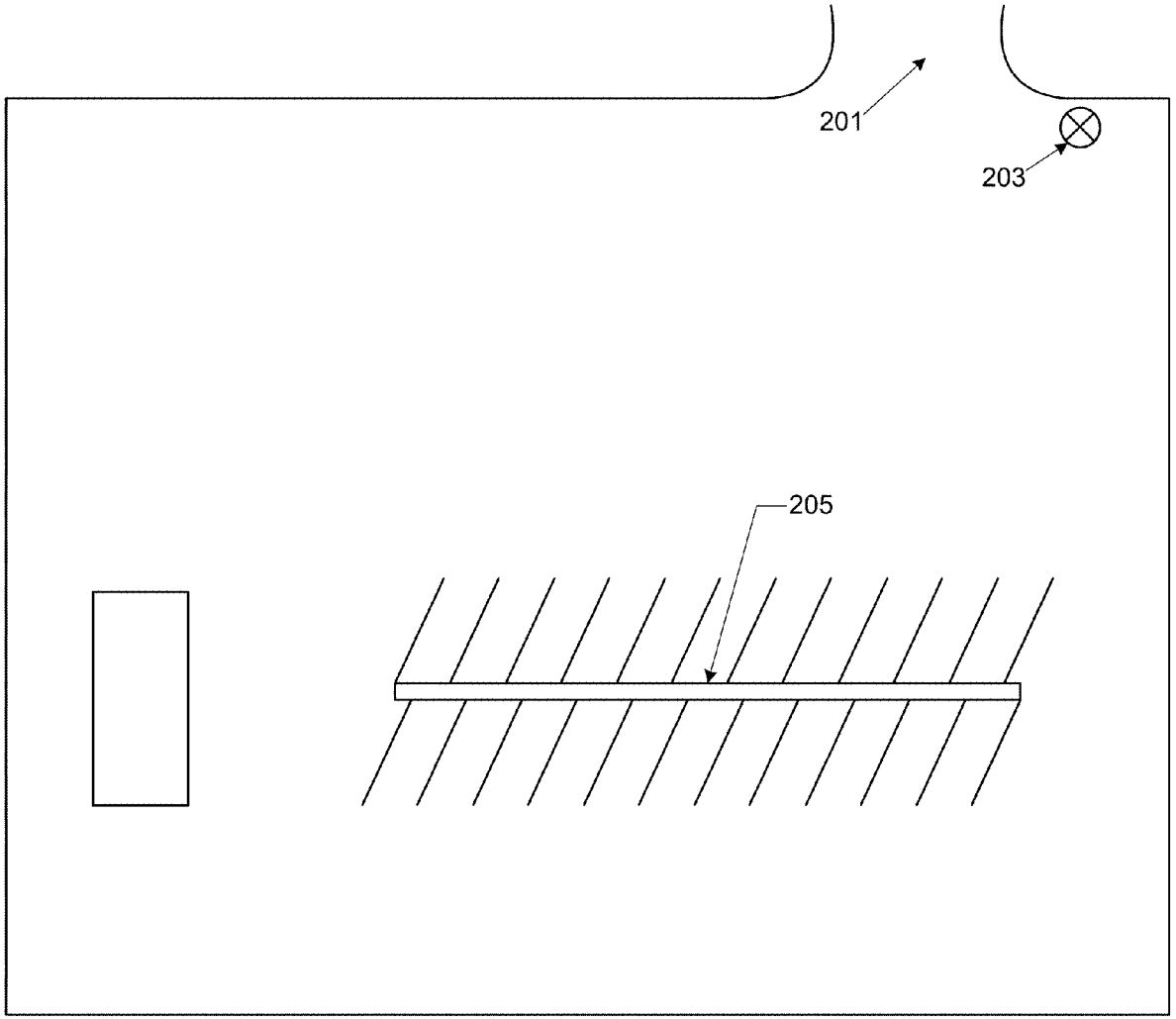
FIG. 2 is an illustration of an exemplary receiver location at a time-fill filling station according to one embodiment of the present invention.

In embodiments where the receiver is located on-site at the refueling station, a radio frequency (or RF) transmitter may be used. Such transmitters may typically have a range of at least about 500 ft in open space. The receiver receives the transmitted data when the receiver is within the transmitters range. In some embodiments, the receiver receives the transmitted data when the NGV enters the refueling site and continues to receive data until the NGV departs the refueling site (as long as the transmitter remains powered and within range of receiver). In other embodiments, a first receiver receives the transmitted vehicular information concurrent with or at some time subsequent to the NGV entering the refueling site (i.e., pre-fueling), but the transmitter passes outside of transmission range before refueling. In these embodiments, the first receiver or a second receiver is located at the facility such that the NGV passes within range of the first or second receiver concurrent with or prior to departure from the refueling site (i.e., post-fueling). An example of this second embodiment is seen in FIG. 2, where a receiver 203 is located near a facility ingress/egress driveway 201. In such an embodiment, a NGV passes within range of the receiver 203 as it enters the facility (pre-fueling) on its way to the time-fill manifold system 205. The NGV again passes within range of the receiver 203 as it exits the facility (post-fueling).

The systems of the present invention allow for tracking and comparison of the NGV pre-fueling and post-fueling fuel fill levels. The difference in the pre- and post-fueling fill levels provides a user with an estimate of the amount of fuel taken on-board by the NGV while at the filling station (i.e., a refueling estimate).

The accuracy of a refueling estimate may be improved with the use of additional vehicular data and/or with the use of additional system components. For example, it is a well-known phenomenon that the pressure of a quantity of gas in a confined space varies with temperature. To this end, in some embodiments the system may comprise one or more temperature sensors configured to measure a temperature (e.g., ambient temperature, temperature of the fuel tank, etc.) at the time of a pressure measurement and provide that temperature measurement to the transmitter. The transmitter then transmits a measured temperature along with a measured pressure to the receiver. The pre- and post-fill measured pressures can then be adjusted to account for any temperature difference at the times of their respective measurements. Such adjustments typically will be conducted with a computer configured to interface with the receiver.

Figure 3A:
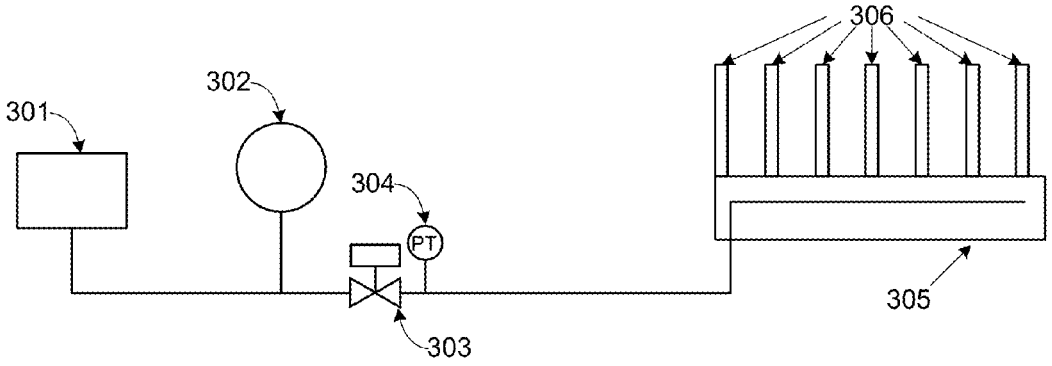
FIG. 3A is an illustration of a typical time-fill filling station.
Figure 3B:
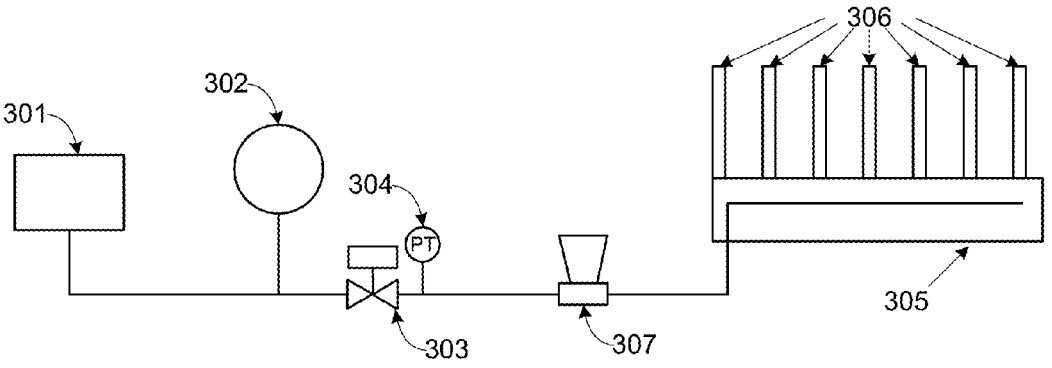
FIG. 3B is an illustration of an exemplary time-fill filling station comprising a gas flowmeter upstream of a manifold distribution system according to one embodiment of the present invention.

In addition or in the alternative, a refueling estimate may also be improved by the addition of additional measuring components to the refueling system itself. A typical time-fill refueling system is shown in FIG. 3A. Such systems typically comprise a gas dryer and compressor 301, a gas storage container 302, a shut-off valve 303, a pressure sensor 304, and a manifold fill system 305 with a plurality of access points 306. In some embodiments, the system further comprises a gas flowmeter 307 (seen in FIG. 3B). A single gas flowmeter 307 located upstream of the manifold fill system may not be sufficient to measure the amount of gas provided to an individual NGV, as multiple NGVs are typically connected to the refueling manifold 305 at the same time. However, a single gas flowmeter 307 does provide a measure of the total amount of gas provided to a plurality of NGVs over a given time. This information can be used to further refine refueling estimates for individual NGVs generated from individual vehicular pressure data, as the sum of individual refueling estimates for each of a plurality of NGVs should equal the total amount of fuel provided to the plurality as measured by the flowmeter.

It should be recognized that certain vehicular information, such as on-board fuel tank capacity, may be, but need not be, transmitted by the transmitter. In some embodiments, the system comprises a computer configured to integrate with the receiver. This computer may have available information that is specific to each NGV outfitted with a transmitter. For example, the computer may have access to a database that includes the on-board storage capacities of NGVs corresponding to unique transmitter or vehicle identification codes. This computer may also be configured to record data received from a transmitter in a non-transient media for later fleet performance and routing analysis.

An exemplary method of using a system described herein is as follows. A receiver is located at a CNG time-fill filling station (i.e., the facility) such that the receiver is within range of a transmitter when the transmitter is at the entry and exit points of the facility. When a transmitter-equipped NGV enters the facility, the on-board transmitter sends a vehicle identification code and a first measured on-board compressed natural gas storage pressure (i.e., pre-fill pressure) to the receiver. The receiver then provides this information to a computer that stores the vehicle identification code, first measured pressure, and time stamp to a database.

The vehicle then continues into the facility where it is connected to the facility's manifold time-fill system and allowed to refuel overnight. The next day, the vehicle is disconnected and sent out of the facility on its route. Prior to exiting the facility, the transmitter again sends the vehicle identification code and a second measured on-board compressed natural gas storage pressure (i.e., post-fill pressure) to the receiver. The receiver again provides this information to a computer that stores the vehicle identification code, second measured pressure, and time stamp to a database.

Pre-fill and post-fill pressures from each vehicle may then be used to calculate an estimate of the amount of fuel that vehicle received while at the facility. If appropriately equipped, additional vehicular information, such as ambient temperature or fuel tank temperature, may also be transmitted as each vehicle enters and exits the facility. Alternatively, or in addition, if the CNG time-fill station is equipped with a gas flowmeter, the total amount of gas delivered by the time-fill system may also be provided to the computer once all NGVs have been disconnected. If available, any or all of this additional data may be used in conjunction with pre- and post-fill pressure data to calculate a refined estimate of fuel received by each vehicle.

Figure 4:
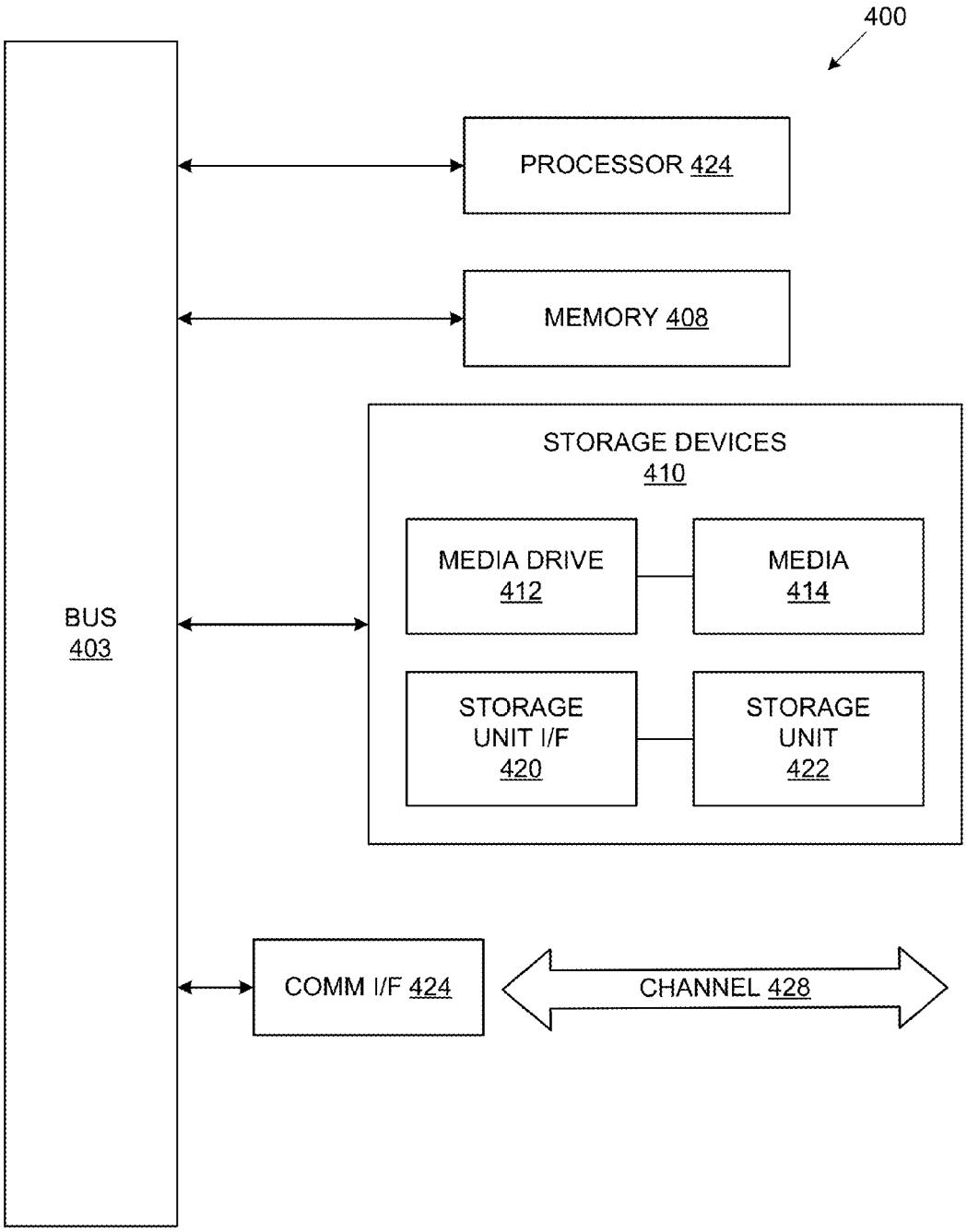
FIG. 4 is a diagram illustrating an example computing module for implementing various embodiments of the invention.

As used herein, the term "module" might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 4. Various embodiments are described in terms of this example-computing module 400. After reading this description, it will become apparent to a person skilled in the relevant art how to implement the invention using other computing modules or architectures.

Referring now to FIG. 4, computing module 400 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 400 might also represent computing capabilities embedded within or otherwise available to a given device. For example, a computing module might be found in other electronic devices such as, for example, digital cameras, navigation systems, cellular telephones, portable computing devices, modems, routers, WAPs, terminals and other electronic devices that might include some form of processing capability.

Computing module 400 might include, for example, one or more processors, controllers, control modules, or other processing devices, such as a processor 404. Processor 404 might be implemented using a general-purpose or special-purpose processing engine such as, for example, a microprocessor, controller, or other control logic. In the illustrated example, processor 404 is connected to a bus 403, although any communication medium can be used to facilitate interaction with other components of computing module 400 or to communicate externally.

Computing module 400 might also include one or more memory modules, simply referred to herein as main memory 408. For example, preferably random access memory (RAM) or other dynamic memory, might be used for storing information and instructions to be executed by processor 404. Main memory 408 might also be used for storing temporary variables or other intermediate information during execution of instructions to be executed by processor 404. Computing module 400 might likewise include a read only memory ("ROM") or other static storage device coupled to bus 403 for storing static information and instructions for processor 404.

The computing module 400 might also include one or more various forms of information storage mechanism 410, which might include, for example, a media drive 412 and a storage unit interface 420. The media drive 412 might include a drive or other mechanism to support fixed or removable storage media 414. For example, a hard disk drive, a floppy disk drive, a magnetic tape drive, an optical disk drive, a CD, DVD or Blu-ray drive (R or RW), or other removable or fixed media drive might be provided. Accordingly, storage media 414 might include, for example, a hard disk, a floppy disk, magnetic tape, cartridge, optical disk, a CD, DVD or Blu-ray, or other fixed or removable medium that is read by, written to or accessed by media drive 412. As these examples illustrate, the storage media 414 can include a computer usable storage medium having stored therein computer software or data.

In alternative embodiments, information storage mechanism 410 might include other similar instrumentalities for allowing computer programs or other instructions or data to be loaded into computing module 400. Such instrumentalities might include, for example, a fixed or removable storage unit 422 and an interface 420. Examples of such storage units 422 and interfaces 420 can include a program cartridge and cartridge interface, a removable memory (for example, a flash memory or other removable memory module) and memory slot, a PCMCIA slot and card, and other fixed or removable storage units 422 and interfaces 420 that allow software and data to be transferred from the storage unit 422 to computing module 400.

Computing module 400 might also include a communications interface 424. Communications interface 424 might be used to allow software and data to be transferred between computing module 400 and external devices. Examples of communications interface 424 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 424 might typically be carried on signals, which can be electronic, electromagnetic (which includes optical) or other signals capable of being exchanged by a given communications interface 424. These signals might be provided to communications interface 424 via a channel 428. This channel 428 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 408, storage unit 420, media 414, and channel 428. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 400 to perform features or functions of the present invention as discussed herein.

One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

While various embodiments of the present invention have been described above, it should be understood that they have been presented by way of example only, and not of limitation. Likewise, the various diagrams may depict an example architectural or other configuration for the invention, which is done to aid in understanding the features and functionality that may be included in the invention. The invention is not restricted to the illustrated example architectures or configurations, but the desired features may be implemented using a variety of alternative architectures and configurations. Indeed, it will be apparent to one of skill in the art how alternative functional, logical or physical partitioning and configurations may be implemented to implement the desired features of the present invention. Also, a multitude of different constituent module names other than those depicted herein may be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead may be applied, alone or in various combinations, to one or more of the other embodiments of the invention, whether or not such embodiments are described and whether or not such features are presented as being a part of a described embodiment. Thus the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, may be combined in a single package or separately maintained and may further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives may be implemented without confinement to the illustrated examples. For example, block diagrams and their accompanying description should not be construed as mandating a particular architecture or configuration.

The invention claimed is:

1. A method of estimating the amount of natural gas provided to a vehicle at a natural gas time-fill filling station, comprising:

measuring a first pressure of compressed natural gas in a compressed natural gas storage tank on-board a natural gas vehicle, wherein the first pressure is measured prior to refueling;

wirelessly transmitting the first measured pressure to a receiver concurrent with or subsequent to the vehicle entering a time-fill filling station;

connecting the vehicle to a time-fill filling station manifold and refueling the vehicle;

disconnecting the vehicle from the time-fill filling station manifold and measuring a second pressure of compressed natural gas in the compressed natural gas storage tank on-board the natural gas vehicle, wherein the second pressure is measured after refueling;

wirelessly transmitting the second measured pressure to the receiver concurrent with or prior to the vehicle departing from the time-fill filling station; and comparing the first and second measured pressures to estimate the amount of natural gas provided to the vehicle.

2. The method of claim 1, wherein the receiver is located at the filling-station and the first and second measured pressures are transmitted to the receiver via radio frequency (RF).

3. The method of claim 1, wherein an identification code is transmitted along with the first and second measured pressures, the identification code useful to identify a particular vehicle.

4. The method of claim 1, further comprising:

measuring a first ambient or storage tank temperature at the same time the first pressure is measured; and transmitting the first ambient or storage tank temperature to the receiver along with the first measured pressure.

5. The method of claim 4, further comprising:

measuring a second ambient or storage tank temperature at the same time the second pressure is measured; and transmitting the second ambient or storage tank temperature to the receiver along with the second measured pressure.

6. The method of claim 5, wherein the first measured pressure, second measured pressure, or both are adjusted based on the first and second measured temperatures prior to estimating the amount of natural gas provided to the vehicle.

7. The method of claim 1, further comprising repeating the method for each of a plurality of natural gas vehicles wherein each of the plurality of natural gas vehicles receive fuel from the time-fill filling station manifold at the same time.

8. The method of claim 7, further comprising providing gas flowmeter data from the time-filling station indicating a total amount of gas provided to the plurality of natural gas vehicles refueled by the station.

9. The method of claim 8, further comprising adjusting one or more estimates of the amount of natural gas provided to each of the plurality of natural gas vehicles refueled by the station so that a sum of estimates of natural gas provided to each of the plurality of natural gas vehicles corresponds with the gas flowmeter data.

10. A method, comprising:

measuring a first pressure of compressed natural gas in a compressed natural gas storage tank on-board a natural gas vehicle, wherein the first pressure is measured prior to refueling;

wirelessly transmitting the first measured pressure to a receiver concurrent with or subsequent to the vehicle entering a time-fill filling station;

connecting the vehicle to a time-fill filling station manifold and refueling the vehicle;

disconnecting the vehicle from the time-fill filling station manifold and measuring a second pressure of compressed natural gas in the compressed natural gas storage tank on-board the natural gas vehicle, wherein the second pressure is measured after refueling.

11. The method of claim 10, further comprising:

wirelessly transmitting the second measured pressure to the receiver concurrent with or prior to the vehicle departing from the time-fill filling station; and comparing the first and second measured pressures to estimate the amount of natural gas provided to the vehicle.

12. The method of claim 11, further comprising:

measuring a first ambient or storage tank temperature at the same time the first pressure is measured; and transmitting the first ambient or storage tank temperature to the receiver along with the first measured pressure.

13. The method of claim 12, further comprising:

measuring a second ambient or storage tank temperature at the same time the second pressure is measured; and transmitting the second ambient or storage tank temperature to the receiver along with the second measured pressure.

14. The method of claim 10, further comprising repeating the method for each of a plurality of natural gas vehicles wherein each of the plurality of natural gas vehicles receive fuel from the time-fill filling station manifold at the same time.

15. The method of claim 14, further comprising providing gas flowmeter data from the time-filling station indicating a total amount of gas provided to the plurality of natural gas vehicles refueled by the station.

* * * * *